US005746063A

United States Patent [19]

Hall et al.

[11] Patent Number: 5,746,063

[45] Date of Patent: May 5, 1998

[54] METHOD AND APPARATUS TO COOL FOOD CONTACT MACHINES AND SURFACE

[76] Inventors: Renee M. Hall; Donald M. Hall, both of 63 N. Country Rd., Mt. Sinai, N.Y. 11766

[21] Appl. No.: 778,958

[22] Filed: Jan. 6, 1997

Related U.S. Application Data

[60] Provisional application No. 60/016,864 May 6, 1996.

[51] Int. Cl.[6] ..... F25B 21/02; F25D 23/12

[52] U.S. Cl. ..... 62/331; 62/32

[58] Field of Search ..... 62/331, 3.2, 3.3, 62/258, 3.6, 3.62

[56] References Cited

U.S. PATENT DOCUMENTS

| | | | |
|---|---|---|---|
| Re. 26,276 | 10/1967 | Hirschhorn | 62/3.2 |
| 1,800,150 | 4/1931 | Musgrave et al. . | |
| 1,942,082 | 1/1934 | Biancalana | 257/212 |
| 1,942,083 | 1/1934 | Biancalana | 257/212 |
| 2,105,566 | 1/1938 | Waunch | 62/331 |
| 2,359,926 | 10/1944 | McCullough et al. | 29/157.3 |
| 2,665,724 | 1/1954 | Lundell | 146/182 |
| 2,792,042 | 5/1957 | Dwyer et al. | 146/189 |
| 2,895,311 | 7/1959 | Spalvins | 62/258 |
| 3,422,600 | 1/1969 | Chamberlain | 55/126 |
| 3,816,875 | 6/1974 | Duncan et al. | 17/52 |
| 3,927,588 | 12/1975 | Laderach | 83/15 |
| 3,952,794 | 4/1976 | Spanoudis | 165/2 |
| 4,189,928 | 2/1980 | Cerny | 62/66 |
| 4,214,345 | 7/1980 | Duncan et al. | 17/11 |
| 4,306,616 | 12/1981 | Woods et al. | 165/136 |
| 4,738,113 | 4/1988 | Rudick | 62/3 |
| 4,802,340 | 2/1989 | Johnson | 62/229 |
| 4,891,949 | 1/1990 | Caldarola | 62/3.2 |
| 5,000,086 | 3/1991 | Bartling | 99/455 |
| 5,117,649 | 6/1992 | Mangini et al. | 62/251 |
| 5,181,456 | 1/1993 | Theys et al. | 99/485 |
| 5,363,672 | 11/1994 | Moore et al. | 62/258 |
| 5,363,746 | 11/1994 | Gordon | 99/328 |
| 5,520,941 | 5/1996 | Oosterling | 426/232 |

OTHER PUBLICATIONS

"How Things Work in Your Home (and What to Do When They Don't", published article in Time-Life Books, New York, ©1975.

Anglin, Donald L. "Heat Exchanger", Grolier Electronic Publishing, Inc., Excerpt from compact disc electronic encyclopedia, one page, copyright 1995.

*Primary Examiner*—William Doerrler

*Attorney, Agent, or Firm*—Alfred M. Walker

[57] ABSTRACT

A cooling and refrigeration apparatus cools surfaces of meat cutting machines, scales, and food preparation areas so as to inhibit bacterial and other microbial growth. The apparatus includes a cooler to lower the temperature of the food contact surfaces to a predetermined temperature which inhibits bacteria and other microbial growth by providing a surface at the predetermined temperature adjacent to or at the food handling surfaces. The cooler is either a thermoelectric module or an accessory source of cooled air.

13 Claims, 7 Drawing Sheets

METHOD AND APPARATUS TO COOL FOOD CONTACT MACHINES AND SURFACE

This application is based upon provisional application number 60/016,864, filed May 6, 1996.

FIELD OF THE INVENTION

The present invention is related to cooling and refrigeration methods and devices to cool surfaces of meat cutting machines, scales, and food preparation areas so as to inhibit bacterial growth.

BACKGROUND OF THE INVENTION

The danger of bacterial infestation of food products such as meat is well known. It is also known that bacteria congregate and grow on meat handling surfaces such as meat slicers, scales and food preparation areas. This also applies to other foods such as fish and cheese. It is further known that refrigeration of food inhibits the growth of bacteria.

OBJECTS OF THE INVENTION

It is therefore an object of the present invention to reduce the temperature of food contact surfaces below ambient temperature to inhibit bacterial growth and preferably to a temperature equal to or below the bacteriostat temperature of health and sanitary code standards for food preservation and preparation.

It is also an object of the present invention to be able to retrofit existing meat slicers and scales with this cooling apparatus.

It is another object of the present invention to optimally cool the surfaces of newly configured meat slicers and scales.

It is yet another object of the present invention to cool food preparation surfaces on tables, counter tops, cabinets, work counters, special purpose food preparation stations and on portable food preparation work surfaces.

It is a further object of the present invention to use thermoelectric devices to produce the cooling effect.

It is another object of the present invention to use cool air streams to reduce or eliminate condensation of ambient humidity on these cooled surfaces.

It is a further object of the present invention to rely on existing refrigerated equipment to supply the cooling energy required for these surface cooling efforts.

SUMMARY OF THE INVENTION

In keeping with these objects and others which may become apparent, the present invention relates to methods and refrigeration and cooling devices combined with machines such as meat slicers and scales to lower their surface temperatures to inhibit bacterial growth. The present invention also applies to the cooling of food preparation surfaces, such as tables, cabinets, work counters, special purpose food preparation stations, and on portable food preparation work surfaces.

This reduction in temperature is predetermined to be sufficient to reduce the overall temperature of the slicer body frame equal to, or below, the temperature that is specified for refrigerated food storage. The reduction in temperature may also be optionally predetermined to be any other temperature below the ambient temperature, that may not be as low as the temperature prescribed as suitable for perishable food storage, but wherein the reduced temperature in the areas where food comes in contact with the slicer is sufficiently low enough to reduce the amount of bacteria that grows on the slicer body and the slicer blade.

Bacteria grows on the slicer body and slicer blade due to the meat juices and food debris deposited on the slicer following the act of cutting or slicing meats and/or cheeses. A number of methods can be employed to accomplish the reduction in temperature of the slicer frame, and slicer blade.

For example, a meat slicer may be equipped with thermoelectric cooling, wherein the frames of the meat slicer are usually made of a material, such as cast aluminum, which has good thermal conductivity and lends itself to retrofitting with thermoelectric modules that can be adhesively or mechanically bonded by their cold plates to the various surfaces of the meat slicer. The base of the slicer may preferably include a thermoelectric module thereon on a surface, such as the underside thereof. The carriage of the slicer is moved by an insulated handle for operator comfort. The cutting blade of the meat slicer, and its cutting extension, are cooled by one or more thermoelectric modules, which may optionally include a plurality thereof, such as three thermoelectric modules located on the blade cover of the slicer.

Each cooler, such as a thermoelectric module, reduces the surface temperature, of a food handling surface adjacent to or on top of, the thermoelectric module, to a predetermined temperature below which temperature the growth of bacteria and other microorganisms is inhibited.

Optionally, when a sponge is used to periodically clean the slicer blade by actually slicing it with the meat slicer, another optional accessory to reduce bacterial growth on the sponge is storage of the sponge in a cooled compartment with its own thermoelectric module, or other source or supply of cooling. The cooling compartment may also be used to store other commonly used food preparation utensils, such as a trim knife.

An angled trough preferably encircles the base of the slicing machine and collects humid condensate to be discarded.

The humid condensate is also removed by a conduit, such as a hose, that drips directly into a collection drain.

The thermoelectric module preferably includes one or more layers, such as three layers. Optionally, it can also have a pancake fan as a fourth layer. A cooling plate of the thermoelectric module is cooled by supplying electrical power, such as, for example, direct current, to a thermoelectric layer which draws heat from the cooling plate to a hot finned plate.

In connection with the thermoelectric module, an enlarged heat sink or finned heat exchanger may be used to dissipate the heat passively to ambient air by natural convection. An optional small flat fan unit can draw ambient air and discharges heated air peripherally through fins. The optional fan insulates personnel using the device from a hot plate and enhances the efficiency of the thermoelectric module. In one embodiment, one or more thermoelectric modules used on the slicing machine are wired in parallel to an electrical power supply, such as, for example, a direct current low voltage power supply, which may be remotely located or placed under or adjacent to the meat slicer. Furthermore, a built-in power supply compartment and switch may be optionally provided.

The thermoelectric module may also act as a bacteriostat or microbial reducer for different types of meat slicers, such as to cool a spiked meat cutting plate with upwardly extending meat spikes. In this embodiment, a cold plate of the thermoelectric module is attached by bonding or otherwise to a base plate, to cool the spikes by conduction. The upwardly extending meat spikes must be cooled, since the spikes contact a food item, such as a piece of meat.

In another embodiment, a typical meat weighing scale, having a base and a food platform, uses a thermoelectric module to cool the food contact surface by conduction. While this embodiment can be used to retrofit some scales, a predetermined distance must be provided between the thermoelectric module and the base.

When applied to a conventional scale, the cooling accessory may be a separate cooling unit providing cool air streams to the scale. The separate cooling accessory may use either thermoelectric modules such as, for example, solid state thermoelectric modules, or a conventional vapor compression refrigeration system to provide a supply of cool air, or it may draw cool air from the interior of a nearby refrigerated case.

In this particular embodiment, ambient air is drawn through one or more intake vents and is cooled within the unit. The cool air streams are then discharged respectively through outlets, such as one or more adjustable outlet nozzles, so that they impinge on the top surface and underside of the food weighing platform of the scale. Additional ambient air may be drawn through vents to cool the condenser of a conventional refrigeration apparatus or the hot plates of thermoelectric modules. The heated air may be then discharged through outlets, such as outlet vents on top of the cooling unit.

Therefore, slow streams of cooled air cool the food contact surface of the weighing platform of a weighing scale. The use of cooled air streams also eliminates or minimizes any tendency to form humid condensate, such as sweated droplets, on the cooled surfaces since ambient humid air is removed from contact with the cooled surfaces.

In a further embodiment for a meat slicer, a conduit, such as a flexible hose, supplies cool air from a remote source at a slight pressure. The sources of this cooled air may be a dedicated refrigeration unit in the base of the meat slicer itself, or a refrigeration unit within the stand upon which the meat slicer resides. Moreover, the sources of this cooled air may also be a separate heat exchanger placed inside an under cabinet cooler or a blower fan placed inside of the refrigerated space of a typical refrigerated case at a delicatessen or supermarket. The sources of the cooled air may also be a suction fan mounted under the slicer base, which also pulls cool air from the interior of a typical refrigerated case at a delicatessen or supermarket. The slicer motor may be designed to include a vacuum draft fan blade to pull cold air inside the slicer housing.

In the embodiment with a conduit, the base of the meat slicer is sealed to provide a pressurized cavity for entry of the cooled air. The conduit conveys cooled air from the housing cavity to a further conduit, such as a plenum, which is custom fitted around the parts of the slicer contacting the food, such as the rotating blade or the body under the blade.

The slow stream of cool air is directed further through outlets such as nozzles or vent outlets over the blade, the base extension under the blade and the carriage surfaces cooling these to a desired temperature. The frame of the meat slicer is cooled by conduction from the cool air within.

For embodiments with one or more work stations, such as a cabinet with one or more cooled work surface pads, such as, for example, three, by using appropriately sized thermoelectric modules whose cold plate is attached to an underside of each work surface pad, the cooling is easily accomplished. An optional exhaust fan and one or more inlet vents can be used. The vents are used to exhaust the heat produced by the one or more thermoelectric modules inside of the cabinet comprising the one or more work station embodiment.

In this one or more work station embodiment, a switch preferably controls the power to the power supply, such as direct current, of each of the thermoelectric modules. Optionally, to minimize sweating of humid condensate, a source of cool air may be provided to slowly move through vents over the surface of each of the work station pads. In this one or more work station embodiment, the cabinet may house a refrigerated space and the side walls and counter top around the cooled work pads may be insulated. Preferably, a heat exchanger in the refrigerated space is used to supply cool dry air to the vents through a manifold. Optionally, a blower pulls ambient air through various intake means, such as sealing louvers, into the heat exchanger, where it is cooled and dehumidified and discharged under slight pressure to the manifold. Any condensate is discharged from the heat exchanger through a conduit which is then conveyed to an outlet collector, such as a drain.

Also with respect to this one or more work station embodiment, the underside of each of the work station pads may be cooled by impingement of cold ambient air inside the cabinet, as moved by moving means, such as blowers or fans, which are operated by switches. Preferably, insulated covers are provided for the cooled work surface pads, to minimize heat loss through the thermally conductive work pad material during periods of non use.

In several embodiments of the embodiments, cold air streams blow over food contact surfaces. For example, as noted above, a scale may be connected by a conduit to a separate cooling accessory, or a meat slicer may use an external cool air source. Likewise, a refrigerated case can be modified to provide an easy connection for transferring cold air from the interior of the refrigerated case to a food handling device.

Likewise, the refrigeration case manufacturer can provide a port or easy connection where the food preparation device or work surface can access cool air from the interior of the refrigerated case.

However, since it is not desirable to increase exposure of food items to airborne bacteria, high efficiency particulate filter (HEPA) elements are preferably fitted either to the inlet or to the outlet vents of the cold air handlers. Therefore, by blanketing the areas with filtered cool air, the effect is a reduction of exposure of food items to airborne bacteria, since the normal ambient air with typical bacteria counts is generally excluded from the immediate affected region.

In a further alternate embodiment for a meat scale with a finned platform. In this alternate embodiment, the scale has a top surface that is not blanketed with cooling air, although cool air is used as the platform cooling medium. In this case, an air filter is not required since air only impinges the undersurface of the platform and the air exhausts at the distal end of the platform after absorbing heat from one or more fins that are part of the underside of the platform, which is typically a cast or extruded metal platform.

In this finned embodiment, a separate source of cool air has an outlet, such as an adjustable outlet vent. Cool air is provided either by a thermoelectric module, by a conventional refrigeration unit or by a weighted outlet enclosure for an externally generated diverted supply of cool air, such as from a refrigerated case. In this finned embodiment, a diverter means, such as an extension of the platform of the scale, channels the air to a proximal end of the underside of the scale platform, where the air communicates with the one or more fins under the scale platform. Optionally, an insulated cover fits over the top of the platform in humid environments to limit any condensate from forming on the top of the scale platform surface during periods of non-use. Other insulated covers can be used to insulate the cold surfaces of the aforementioned embodiments for meat cutters or multiple work zones.

The desired location for the contact of cool air or the thermoelectric device, or devices, since more than one can be utilized on a single slicer installation, is determined by the style of the slicer and the amount of motor heat that is generated by that particular model of slicer, by the ambient temperature, and by the desire to reduce the temperature in those areas of the slicer that come in contact with food.

Since human beings operate manual slicers and interact with automatic slicers, it is desirable to provide an insulated handle so that the employee will not be subjected to the cold temperature of the frame. Likewise the frame is designed to provide for the elimination or control of moisture formed by condensation on the cold frame of the slicer.

Furthermore, since it is possible that slicers may be manufactured from material other than aluminum, it should be recognized that the principles of temperature reduction that are described herein can be applied to stainless steel, plastic, and chrome plated materials as well. Other food processing equipment, such as a weighing scale, or weighing and labeling scales, can be likewise modified in design or as retrofit packages to provide the same benefits and features described above.

BRIEF DESCRIPTION OF THE DRAWINGS

The present invention can best be described in conjunction with the accompanying drawings, in which.

DETAILED DESCRIPTION OF THE DRAWINGS

Figure 1:
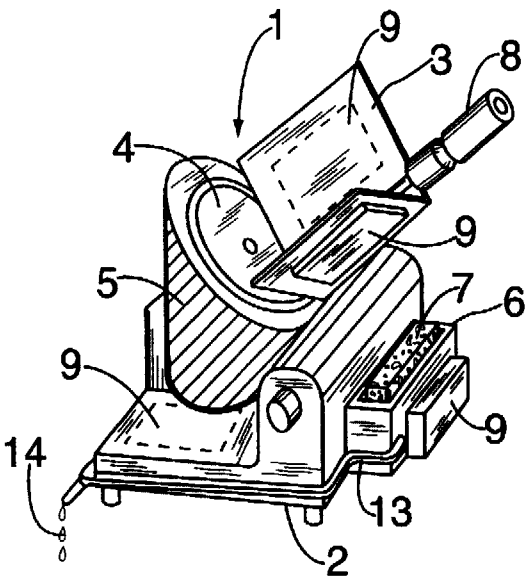
FIG. 1 is an isometric view of an embodiment of the present invention for a surface cooler for food contact surfaces of a meat slicer, shown with thermoelectric cooling.

FIG. 1 shows meat slicer 1 with a surface cooler for food contact surfaces, such as thermoelectric module 9, wherein cooling is accomplished with thermoelectric cooling. The frames of meat slicers, such as meat slicer 1, are usually made of cast aluminum. This material has good thermal conductivity and lends itself to retrofitting with thermoelectric modules 9 that can be adhesively or mechanically bonded by their cold plates to the various surfaces of meat slicer 1. Likewise, in a new model design the cold plates can be cast into the slicer frame. For example, in FIG. 1, base 2 of meat slicer 1 is shown with a thermoelectric module 9. Slicing carriage 3 is moved by insulated handle 8 for operator comfort. More than one thermoelectric module 9 may be employed. For example, FIG. 1 shows meat slicer 1 with a plurality of thermoelectric modules 9, such as two modules 9.

Figure 2:
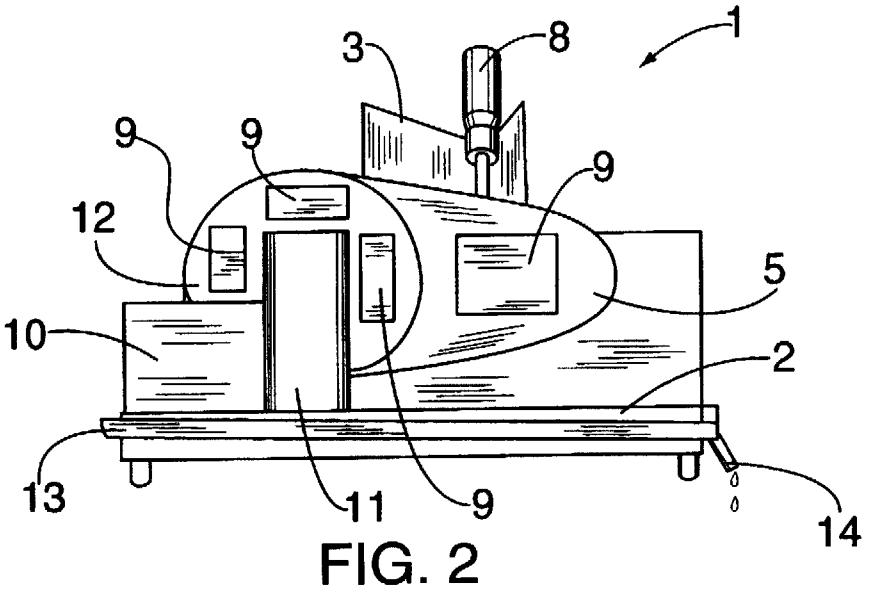
FIG. 2 is a rear view of the surface cooler for food contact surfaces of the meat slicer with thermoelectric cooling as in FIG. 1.

In one embodiment, blade 4 of meat slicer 1 is cooled by its proximity to one or more thermoelectric modules, which directly cool cutting extension 5 and blade housing 12, as shown in FIG. 1 and FIG. 2. Cutting blade 4 is shown being cooled by its proximity to three thermoelectric modules 9 on the back side of the blade cover above motor 10 and above and beside transmission housing 11. Bacteria especially tend to grow on blade 4 itself due to exposure and contact with food, such as meat juices of meat being cut. Sponge 7 is used to periodically clean blade 4 by actually slicing away a portion of sponge 7 with blade 4 of meat slicer 1. Therefore, an optional accessory to reduce bacterial growth on sponge 7 is to store sponge 7 in cooled compartment 6 with its own separate thermoelectric module 9.

Since the ambient environment may have relatively high humidity, the cooled surfaces of meat slicer 1 may tend to sweat as the moisture in the air condenses. Therefore a condensate collector, which may be provided, such as angled trough 13, encircles base 2 of meat slicer 1 and collects condensate 14 in a single location, where condensate 14 can be collected in a container, such as a transparent container, and be periodically discarded.

Condensate 14 can also be conveyed by a conduit, such as a hose, that drips directly into a drain or into the drain system that is part of many refrigerated cases.

Figure 3:
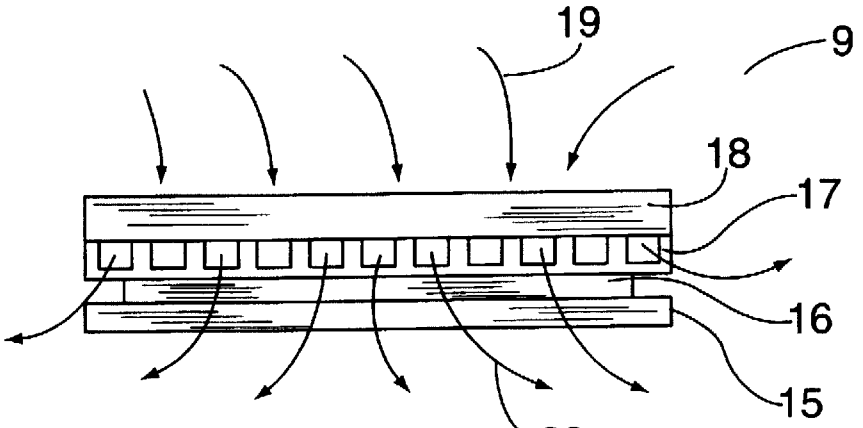
FIG. 3 is a side view of one style of a thermoelectric cooling module used as a surface cooler for food contact surfaces of a meat slicer, as in FIG. 1.

FIG. 3 shows a typical thermoelectric module 9 of the surface cooler for food contact surfaces as in FIG. 1. Thermoelectric module 9 includes preferably one or more layers with or without a pancake fan 18 as an additional layer. Cold plate 15 of thermoelectric module 9 is cooled by supplying electrical power, such as, for example, direct current, to thermoelectric layer 16, which draws heat from cold plate 15 to hot finned plate 17. In some applications, an enlarged heat sink or finned heat exchanger can be used to dissipate the heat passively to ambient air by natural convection. However, in this application, small flat fan unit 18 draws ambient air 19 and discharges heated air peripherally through fins of finned plate 17. Fan 18 insulates personnel using the device from finned plate 17 and enhances the efficiency of thermoelectric module 9. Preferably, thermoelectric units 9 used on slicing machine 1 are preferably wired in parallel to a power supply, such as a direct current low voltage power supply, which may be remotely located or placed under or adjacent to meat slicer 1. In an alternate embodiment for a cooled meat cutter, a built-in power supply compartment and switch are provided.

Figure 4:
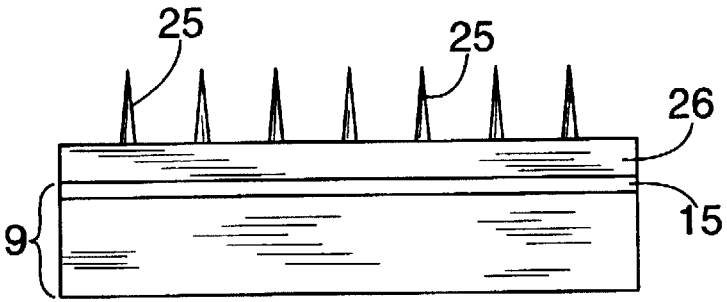
FIG. 4 is a side elevational view of a first alternate embodiment for a thermoelectric cooling module for a surface cooler for food contact surfaces for a meat cutting surface with upwardly extending spikes.

FIG. 4 shows an embodiment for a cooler for food contact surfaces of a meat cutter with a spiked plate, showing thermoelectric module 9 being used to cool spiked plate 26 with meat spikes 25. In the embodiment shown in FIG. 4, cold plate 15 of thermoelectric module 9 is bonded to spiked base plate 26. It is important to cool meat spikes 25, since meat spikes 25 are in most intimate contact with the food item, such as a slab or piece of meat. Spikes 25 themselves are cooled by conduction.

Figure 5:
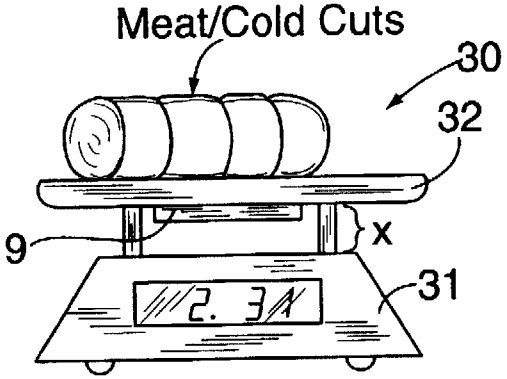
FIG. 5 is a front view of a second alternate embodiment for a surface cooler for food contact surfaces of a food scale, shown with thermoelectric cooling.

FIG. 5 shows a typical food weighing scale 30 with base 31 and food platform 32. Thermoelectric module 9 is used on the underside of platform 32 of scale 30 to cool the food contact surface by conduction. While this arrangement can be used to retrofit some scales, predetermined distance "x" must be adequate to provide clearance for thermoelectric module 9 at the highest rated item weight on scale 30. Also, the tare adjustment must have sufficient range to compensate for the weight of thermoelectric module 9.

Figure 7:
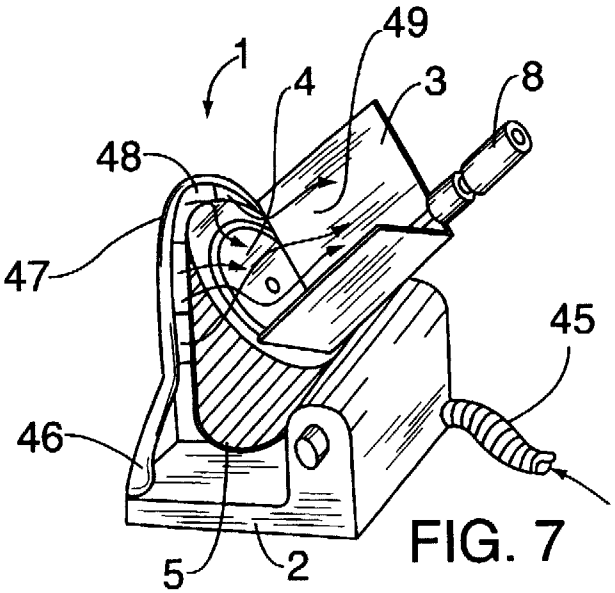
FIG. 7 is an isometric view of a fourth alternate embodiment for a surface cooler for food contact surfaces for a meat slicer, shown using an external cool air source.
Figure 6:
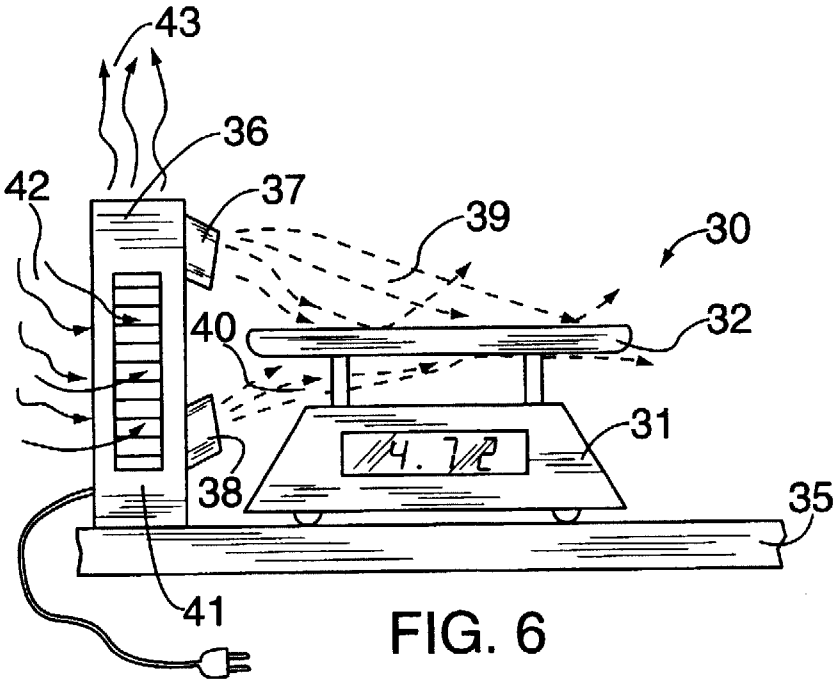
FIG. 6 is a front view of a third alternate embodiment for a surface cooler for food contact surfaces for a scale, shown with a separate cooling accessory.

FIG. 6 shows a conventional scale 30, upon a support surface 35, next to a separate cooling accessory 36. Cooling accessory unit 36 may use one or more solid state thermoelectric modules 9, or a conventional vapor compression refrigeration system, or a source of cooled air, such is found in the interior of a refrigerated delicatessen case, to provide a supply of cool air. In the embodiment shown in FIG. 6, ambient air 42 is drawn through one or more intake vents 41 and is cooled within cooling accessory unit 36. Cool air streams 39 and 40 are then discharged respectively through outlets, such as adjustable outlet nozzles 37 and 38, so that cool air streams 39 and 40 impinge on the top surface and underside of food weighing platform 32 of scale 30. Additional ambient air 42 is drawn through vents 41 to cool the condenser of a conventional refrigeration apparatus or the hot plates of thermoelectric units, such as thermoelectric units 9. Heated air 43 is then discharged through outlet vents on a top surface of cooling accessory unit 36. In this manner, slow streams 39 of cooled air cool the food contact surface of weighing platform 32 of weighing scale 30, without modifying weighing scale 30. The use of cooled air streams 39, 40 also eliminates or minimizes any tendency to form condensate (i.e. sweat) on the cooled surfaces of food support platform 32, since ambient humid air is "washed away" from contact with the cooled surface of food support platform 32. FIG. 7 shows an alternate embodiment for a cooler for food contact surfaces of meat slicing machine 1, with flexible hose 45 supplying cool air from a remote source at a slight pressure. The sources of this cooled air may be a dedicated refrigeration unit in the base of the meat slicer 1 itself or in the stand or cabinet it resides on, or a heat exchanger placed inside and under cabinet cooler, or in a typical refrigerated case at a delicatessen or supermarket, or cool air pushed or pulled from the interior of a refrigerated case. In this embodiment, base 2 of slicing machine 1 is sealed, thus providing a pressurized cavity. First further conduit 46 conveys cooled air from the housing cavity to second further conduit 47, such as a plenum, which is custom fitted around blade 4 and extension 5 of slicing machine 1. Directed outlets 48, such as nozzles or vent outlets, direct a slow stream 49 of cooled air over blade 4, extension 5 and carriage surfaces 3 of slicing machine 1, thereby cooling these to the desired temperature. The frame itself of slicing machine 1 is cooled by convection from the cool air within.

Figure 8:
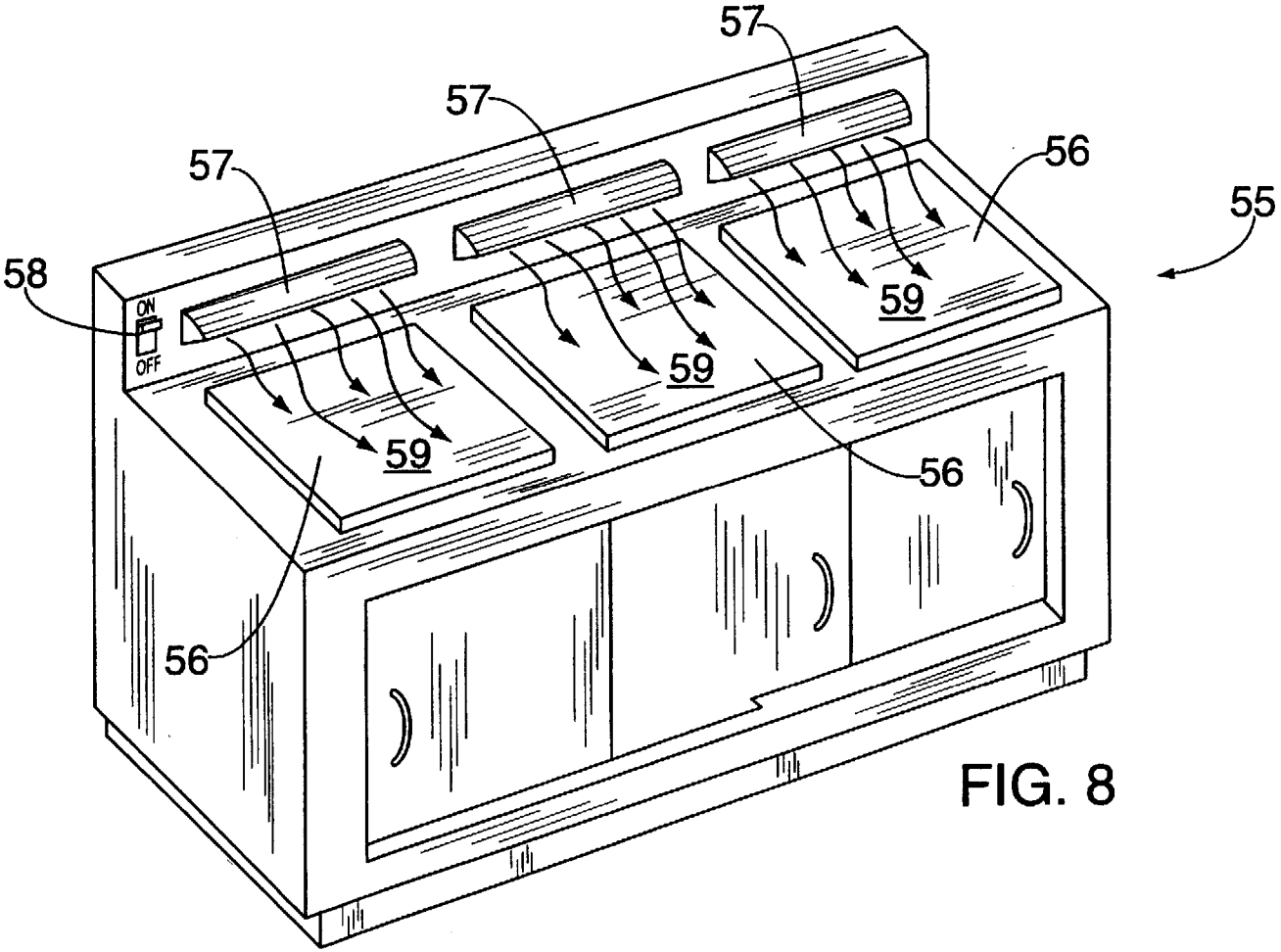
FIG. 8 is an isometric view of a fifth alternate embodiment for a surface cooler for food contact surfaces for a cabinet with a plurality of cold work zones, shown with optional air venting.

FIG. 8 shows another embodiment for a cooler for food contact surfaces of food support device 55, such as a cabinet, with one or more, such as three, of cooled work surface pads 56. Food support device 55 can also be a table top with no cabinet underneath. By using appropriately sized thermoelectric modules, each of whose cold plate is attached to the underside of each pad 56 of food support device 55, the cooling is easily accomplished. A small exhaust fan and inlet vents can be used to exhaust the heat produced by thermoelectric modules inside food support device 55.

Preferably, switch 58 controls the power to the electrical power supply, such as a direct current power supply, of the thermoelectric units (not shown). To minimize sweating, an optional source of cool dry air 59 can be slowly moved through vents 57 over the surface of pads 56.

Figure 9:
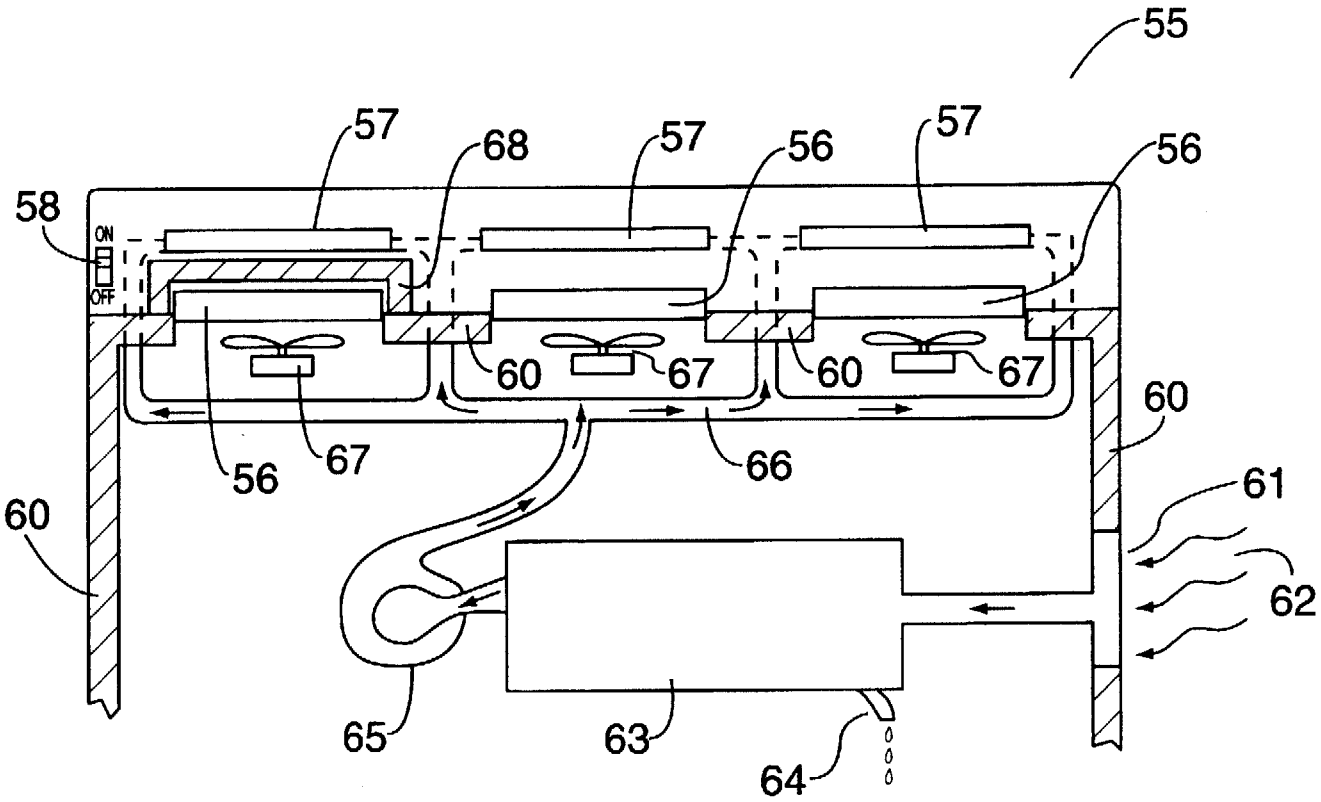
FIG. 9 is a front internal view in partial cross section of a sixth alternate embodiment.

FIG. 9 is an internal view of an alternate embodiment of food support device 55 shown in the previous FIG. 8. In this embodiment, food support device 55 houses a refrigerated space and the side walls and counter top around cooled work pads 56 are insulated by insulation 60. Heat exchanger 63 in the refrigerated space is used to supply cool air to vents 57 through manifold 66. Blower 65 pulls ambient air 62 through sealing louvers 61 into heat exchanger 63, where air 62 is cooled, dehumidified and discharged under slight pressure to manifold 66. Condensate is discharged from heat exchanger 63 through conduit 64, which is then conveyed to a collector, such as a drain. The underside of each pad 56 is cooled by impingement of cold ambient air inside food support device 55 is moved by fans 67. Insulated covers 68 are provided for cooled work surface pads 56 to minimize heat loss through the each thermally conductive work pad 56 during periods of non use. Switch 58 operates blower 65 and fans 67.

In several embodiments, optional cold air streams are shown blowing over food contact surfaces. This includes FIG. 6 showing a scale with a separate cooling accessory, a meat slicer in FIG. 7 using an external cool air source, and the cooled work zones of FIGS. 8 and 9.

Since it is not desirable to increase exposure of food items to airborne bacteria, high efficiency particulate filter (HEPA) elements may be preferably fitted either to the inlet or to the outlet vents of the cold air handlers (not shown). In this manner, by blanketing the areas with filtered cool air, the effect is a reduction of exposure of food items to airborne bacteria, since the normal ambient air with typical bacteria counts is generally excluded from the immediate region.

Figure 11:
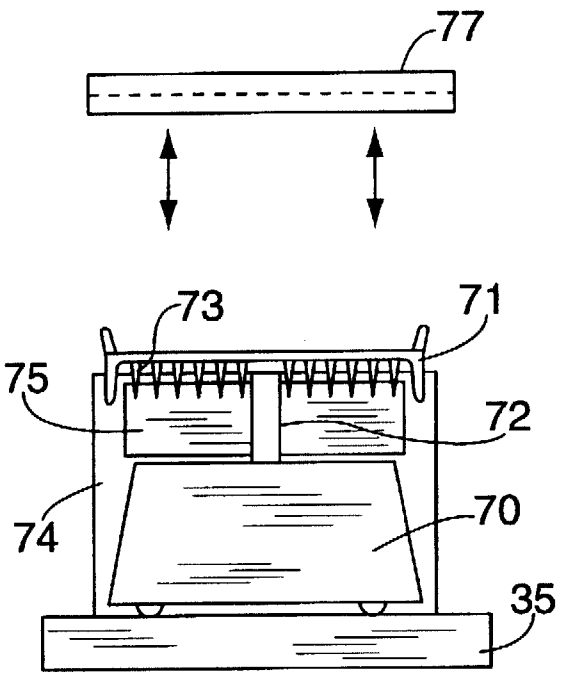
FIG. 11 is a side view of the seventh embodiment for a surface cooler for food contact surfaces for a finned platform scale.
Figure 10:
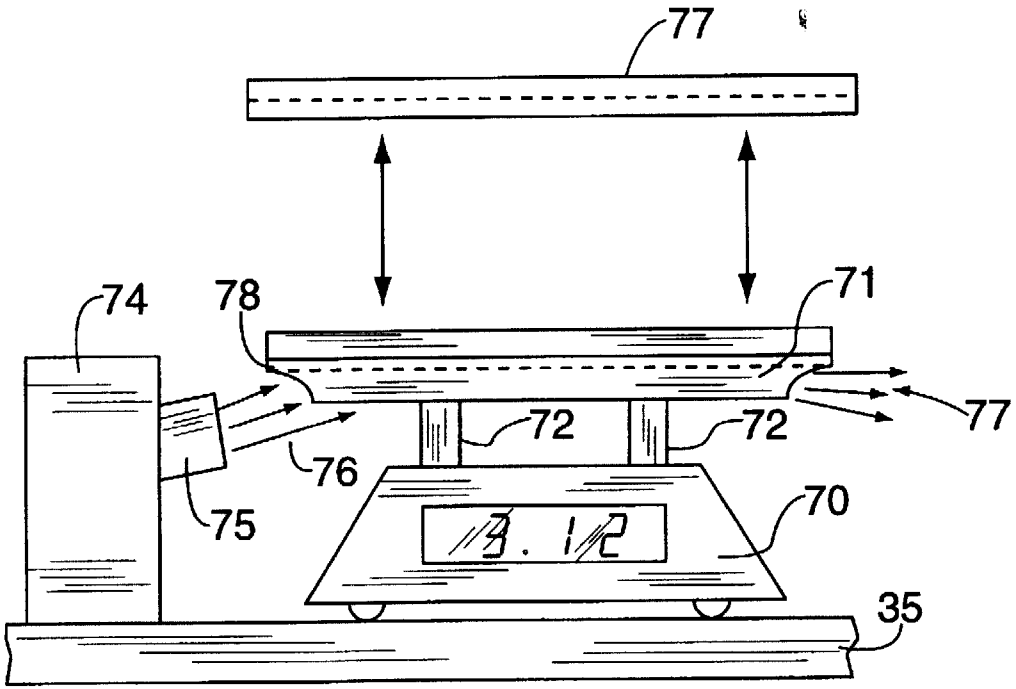
FIG. 10 is a front view of a seventh embodiment for a surface cooler for food contact surfaces for a finned platform scale.

FIG. 10 shows a front view of a scale 70 with a finned platform 71. This alternate embodiment, also shown in a side view in FIG. 11, has a top surface that is not blanketed with cooling air, although cool air is used as the cooling medium for platform 71. In this case, an air filter is not required since air 76 just impinges the undersurface of platform 71 and exhausts at the distal end 77 after absorbing heat from fins 73 that are part of the cast or extruded metal platform 71. Supports 72 are used to attach the platform 71 to weighing scale 70. A separate source of cool air 74 has adjustable outlet vent 75. This may be thermoelectric module 9, or conventional refrigeration unit or simply a weighted outlet enclosure for an externally generated supply of cool air, such as from the interior of a refrigerated case. Extension 78 of platform 71 helps to channel air 76 to the underside of platform 71 where it communicates with fins 73. An insulated cover 77 that fits over the top of platform 71 may be used in humid environments to limit any condensate from forming on the top surface of platform 71 during periods of non-use. This same technique of using insulated covers can be used to advantage on the other equipment, such as cold surfaces such for the meat cutters or work zones.

Figure 12:
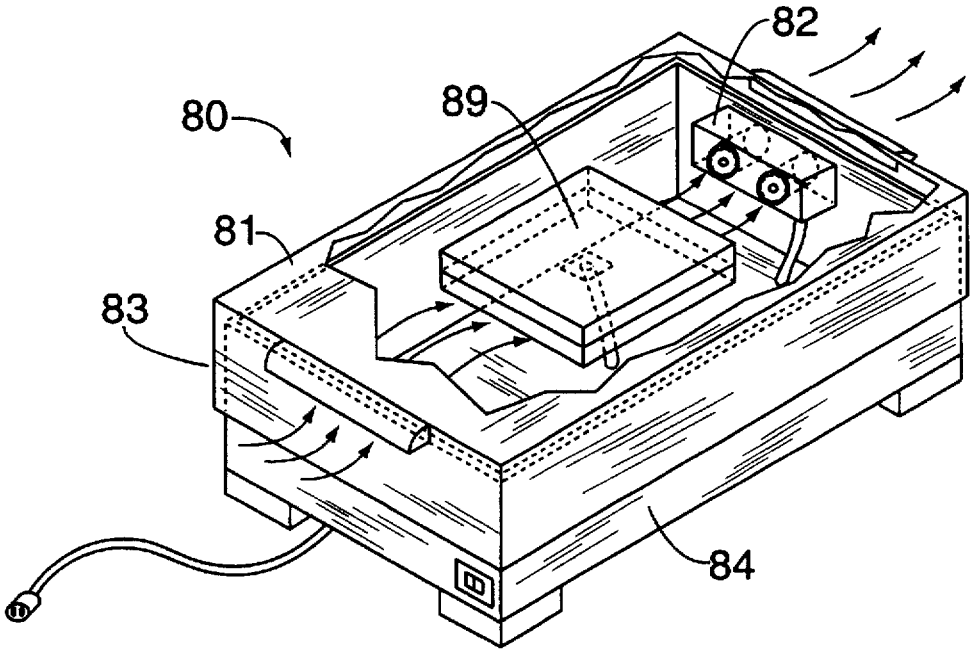
FIG. 12 is a perspective view in cut away of an eighth embodiment for a portable food preparation work station.

FIG. 12 is an embodiment of a portable food preparation work station 80 that utilizes one thermoelectric module 89 for cooling of the upper food work surface area 81. In this embodiment the thermoelectric module does utilize a cooling fan 82. The upper half 83 of the enclosure can be removed for access to the electrical components. The upper lid structure slides over the bottom pan structure 84 with a water tight seal filling the space between the two structures. In another embodiment the entire base assembly can be constructed as a large heat sink with fins that allow the heat generated by the thermoelectric module to be dissipated by convention and conduction. It is contemplated that multiple thermoelectric modules can be utilized and the entire box could be made water tight without need for a cooling fan that would exhaust the heat generated by the thermoelectric module to the outside.

Figure 13:
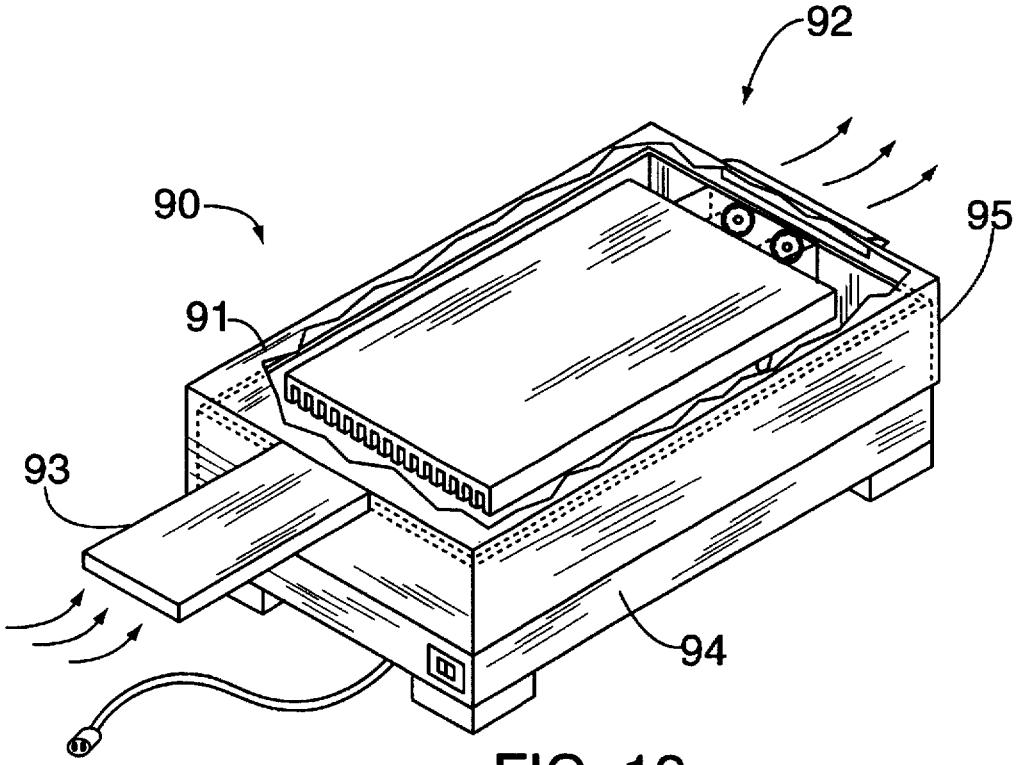
FIG. 13 is a perspective view in cut away of a ninth embodiment for a portable food preparation work station.

FIG. 13 is an embodiment of a portable food preparation work station 90 that utilizes cool air as pulled from the interior area of a refrigerated case into conduit 93 and then into work station 90. The upper half 91 of the enclosure 90 can be removed for access to the interior components, such as the suction fan 92. The upper lid structure 91 slides over the bottom pan structure 94 with a water tight seal 95 filling the space between the two structures 91, 94. Bottom pan structure 94 is manufactured from a non-conductive material so as to minimize the potential for condensation forming on the outer walls of the structure 90. This also serves to conserve the cooling energy needed to cool the upper surface of upper lid structure 91.

Figure 14:
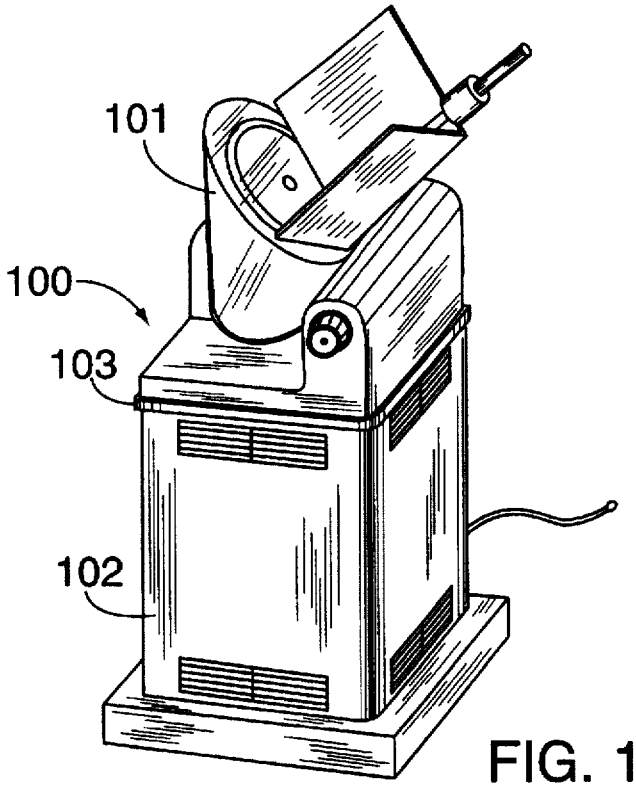
FIG. 14 is a perspective view of a tenth embodiment for a good slicer with a mounting stand and source of refrigeration therein.

FIG. 14 is an embodiment of a single slicer mounting stand 100 that contains its own source of refrigeration. In this embodiment the meat slicer 101 sits on top of a cabinet style enclosure 102 that has its own seal 103 around the upper lip to engage the base of the slicer 101 such that there now exists an air tight seal between the slicer 101 and the cabinet 102. This allows the refrigerated air that is produced by the refrigeration equipment mounted inside of the cabinet 102 to be pushed or pulled into contact with the underside of the slicer 101 such that the slicer frame can be cooled, as noted before in the description of the embodiment shown in FIG. 7 and wherein a slicer is modified to include air passageways for cooled air therethrough. In this embodiment of FIG. 14, a single slicer frame is shown residing on the cabinet 102. Multiple slicers 101 can also be located on a single mounting stand 102 and mounting stand 102 can optionally also provide storage of a slicer sponge and can store food preparation utensils, such as a trim knife.

Figure 15:
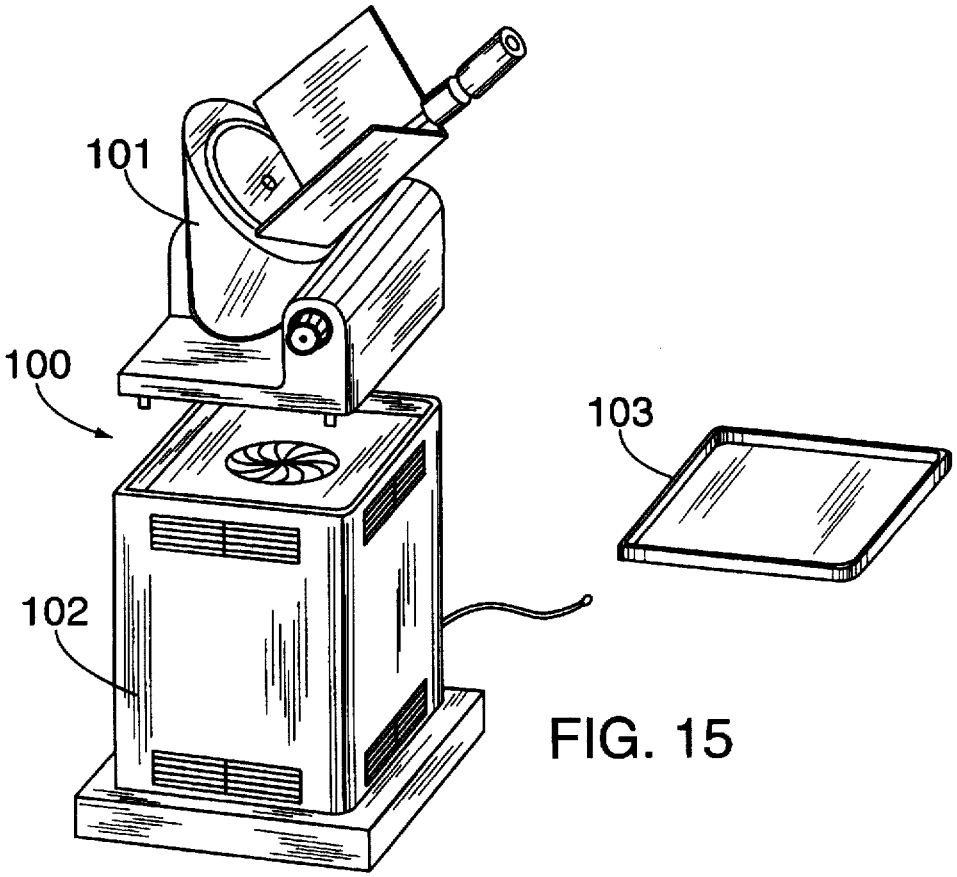
FIG. 15 is a perspective view of the food slicer as in FIG. 14, showing the seal utilized therewith.

FIG. 15 provides a view of seal 103 that may be utilized between the slicer 101 and the slicer mounting cabinet stand 102. Optionally, a heat exchanger can also be mounted in a cabinet style enclosure 102 and the slicer or slicers can work in concert with an existing refrigeration case )not shown).

It is further noted that other modifications may be made to the present invention, without departing from the scope of the invention, as noted in the appended claims.

We claim:

1. A cooler apparatus to inhibit bacterial and microbial growth on a food contact surface of a portable food handling device, such as a slicing machine having a rotatable food cutting blade, said rotatable food cutting blade being rotatable in ambient air, said rotatable food cutting blade contacting and cutting food being cut in ambient air, said cooler apparatus comprising a cooler impinging upon at least one conductive surface of the portable food handling device, said cooler reducing the temperature of the food contacting surface of the portable food handling device to a predetermined temperature for inhibiting the bacterial and microbial growth thereon;

said portable food handling device having a base, a slicing frame mounted with said base, said slicing frame including a motor rotating said rotatable food cutting blade; said portable food handling device further including an open food accommodating carriage spaced apart from said rotatable food cutting blade;

wherein said cooler comprises at least one thermoelectric module attached by a cold plate therein to at least one conductive surface of said portable food handling device;

said thermoelectric module being located in proximity to said rotatable food cutting blade, but said thermoelectric module being located spaced apart from said rotatable food cutting blade.

2. The cooling apparatus as in claim 1 wherein said at least one thermoelectric module comprises a plurality of thermoelectric modules attached by respective cold plates therein to a food support platform of said food handling device.

3. The cooling apparatus as in claim 1 wherein said at least one thermoelectric module comprises a plurality of thermoelectric modules attached by respective cold plates therein to said food handling device to cool the food handling device.

4. A cooler apparatus to inhibit bacterial and microbial growth on a food contact surface of a food handling device, such as a slicing machine, a weighing scale or other food preparation surface, said cooler apparatus comprising a cooler impinging upon a conductive surface of the food handling device, said cooler reducing the temperature of the food contacting surface of the food handling device to a predetermined temperature for inhibiting the bacterial and microbial growth thereon;

wherein said cooler comprises at least one thermoelectric module attached by a cold plate therein to at least one conductive surface of said food handling device;

wherein said at least one thermoelectric module comprises a plurality of thermoelectric modules attached by respective cold plates therein to a plurality of upwardly extending food contact spikes of said food handling device.

5. A cooler apparatus to inhibit bacterial and microbial growth on a food contact surface of a food handling device, such as a slicing machine, a weighing scale or other food preparation surface, said cooler apparatus comprising a cooler impinging upon a conductive surface of the food handling device, said cooler reducing the temperature of the food contacting surface of the food handling device to a predetermined temperature for inhibiting the bacterial and microbial growth thereon;

wherein said cooler comprises at least one thermoelectric module attached by a cold plate therein to at least one conductive surface of said food handling device;

wherein said at least one thermoelectric module is attached to a sponge holding compartment, said compartment having a blade cleaning sponge insertable therein.

6. The cooling apparatus as in claim 1 further comprising a condensate collector for collection of humid condensate.

7. The cooling apparatus as in claim 1 wherein said thermoelectric module comprises a multi-layer module having a plurality of layers.

8. The cooling apparatus as in claim 2 wherein said thermoelectric module comprises a multi-layer module having a plurality of layers.

9. The cooling apparatus as in claim 8 wherein said cold plate of said thermoelectric module is cooled by supplying electrical power to at least one thermoelectric layer, which said thermoelectric layer draws heat from said cold plate to a hot finned plate.

10. The cooling apparatus as in claim 8 further comprising a heat exchanger, said heat exchanger dissipating heat passively to ambient air by natural convection.

11. A cooler apparatus to inhibit bacterial and microbial growth on a food contact surface of a food handling device, such as a slicing machine, a weighing scale or other food preparation surface, said cooler apparatus comprising a cooler impinging upon a conductive surface of the food handling device, said cooler reducing the temperature of the food contacting surface of the food handling device to a predetermined temperature for inhibiting the bacterial and microbial growth thereon;

wherein said cooler comprises at least one thermoelectric module attached by a cold plate therein to at least one conductive surface of said food handling device;

wherein said thermoelectric module comprises a multi-layer module having a plurality of layers;

wherein said thermoelectric module comprises a plurality of thermoelectric modules wired in parallel to an electrical power supply communicating with said food handling device.

12. The cooler apparatus as in claim 1 wherein said food accommodating carriage is movable.

13. The cooler apparatus as in claim 1 wherein said at least one thermoelectric module comprises a plurality of thermoelectric modules.

* * * * *